United States Patent [19]

Veaute

[11] 4,226,749

[45] Oct. 7, 1980

[54] SIZING COMPOSITION WITH CATIONIC AND ANIONIC COMPONENT

[75] Inventor: Georges Veaute, Paris, France

[73] Assignee: Manufacture de Produits Chimiques Protex S.A., Paris, France

[21] Appl. No.: 923,338

[22] Filed: Jul. 10, 1978

Related U.S. Application Data

[63] Continuation-in-part of Ser. No. 908,767, May 23, 1978, abandoned.

[30] Foreign Application Priority Data

May 23, 1977 [FR] France ..... 77 16628

[51] Int. Cl.[3] ..... C08L 3/02

[52] U.S. Cl. ..... 260/17.3; 260/17.4 BB; 260/17.4 ST; 260/29.2 EP; 260/29.2 N; 260/29.2 UA; 260/29.4 R; 260/42.26; 260/42.52; 260/42.55; 428/514; 428/532; 428/537

[58] Field of Search ..... 260/29.2 UA, 29.2 N, 260/29.2 EP, 29.4 R, 9, 17.4 ST, 17.3, 17.4 BB, 42.26

[56] References Cited

U.S. PATENT DOCUMENTS

| | | | |
|---|---|---|---|
| 2,616,861 | 11/1952 | Jones | 260/17.3 |
| 2,790,735 | 4/1957 | McLaughlin | 162/168 R |
| 2,804,436 | 8/1957 | Ritson | 260/17.4 |
| 3,872,039 | 3/1975 | Vaughn et al. | 260/17.4 ST |
| 3,925,328 | 12/1975 | Shibahara et al. | 260/17.4 ST |
| 4,030,970 | 6/1977 | Tominago et al. | 428/514 |

FOREIGN PATENT DOCUMENTS

| | | | |
|---|---|---|---|
| 2619848 | 11/1976 | Fed. Rep. of Germany . | |
| 1551482 | 12/1968 | France . | |
| 1456629 | 11/1976 | United Kingdom | 260/17.4 ST |

OTHER PUBLICATIONS

Chem. Absts., vol. 71:62452y, Copolymer Coatings for Paper, Badische Anilin.

*Primary Examiner*—Edward M. Woodberry
*Attorney, Agent, or Firm*—Karl F. Ross

[57] ABSTRACT

Paper is coated or sized with a composition which includes in addition to the used paper-treating agents one or more cationic compounds and a dispersion of a polymer soluble in an alkaline medium and consisting of an alkali metal salt or alkaline earth salt of an unsaturated carboxylic acid, or a copolymer obtained by polymerization or an unsaturated carboxylic acid with acrylic or methacrylic acid esters.

2 Claims, No Drawings

SIZING COMPOSITION WITH CATIONIC AND ANIONIC COMPONENT

CROSS REFERENCE TO RELATED APPLICATION

This application is a continuation in part of Ser. No. 908,767 filed May 23, 1978 now abandoned and related to commonly assigned Ser. No. 600,906 filed July 31, 1975 now abandoned and to Ser. No. 921,008 filed June 30, 1978 by Gerard Tesson, now allowed.

FIELD OF THE INVENTION

The present invention relates to the coating or sizing of paper and, more particularly, to a paper-coating composition and to a method of coating paper.

BACKGROUND OF THE INVENTION

It is known to provide paper with sizing or coatings facilitating printing, resisting moisture and for many other purposes, including improvement of the appearance and strength of the paper, reduction of the light permeability (increase of capacity) thereof, etc.

For economical reasons it is desirable to make paper with a minimum sheet thickness and hence a minimum weight. However, the reduction in the sheet thickness or weight results in the need to correlatively reduce the quantity of the coating material which can be applied to a surface. This reduction in coating weight is also made necessary by machine at high speed. It is not uncommon for the paper to pass through the coating machine at speeds of 900 meters per minute, at times up to 1200 meters per minute.

It is desirable to apply the coating in the form of a paste because the mechanical properties thereof (rheology, water retention, fiber coverage) are significant advantages in ensuring uniformity of the coating and the ability to print uniformly and cleanly thereon.

Experience has shown that there is a limit to attempts to reduce the basis weight of paper and hence the sheet thickness. For example, it is not practical to reduce the basis weight of paper below 50 to 52 grams per $m^2$ because the opacity of the paper is lost and there is a significant reduction of strength. Further when the coating is aplied in as small an amount as 10 g per $m^2$ on a fiber support with a basis weight of 60 g per $m^2$, it is found that it is not possible to cover more than 80 to 85% of the surface of the support.

This latter defect is due to the necessity of using baths with proportions of dry material in solution which are relatively low in order to obtain coating of low weights per unit area at high speeds. Because of the need to employ low viscosity baths, it is also necessary to accept a significant penetration of the coating material into the fabrics support either because of migration under the blade or by capillary migration.

In order to eliminate these disadvantages and maintain to a maximum degree the moist film on the surface, it is necessary to increase the concentration of those agents which serve to retain moisture. All this, however, results in an increase in the viscosity of the film and a marked tendency for the coating to gel and thus to form upon drying a rough or wrinkled film which cannot be corrected by calendaring or glossing. The defects in the paper may only be exposed during printing and can result in a large proportion of the printed products being discolored and having surface or other undesirable characteristics. Consequently there is a loss in the product resulting from the compromise of the coating composition between the desire to apply a thin coating to the paper surface and the need to utilize moisture retentive materials to a high degree in such coatings.

OBJECTS OF THE INVENTION

It is the principal object of the present invention to provide an improved method of coating paper which will obviate the disadvantages discussed previously.

Another object of this invention is to provide an improved composition for the coating of paper.

SUMMARY OF THE INVENTION

These objects and others which will become apparent hereinafter are attained, in accordance with the present invention which is based upon my discovery that significant disadvantages of earlier systems for the coating of paper can be obviated when the coating composition contains, in addition to the usual sizing materials in such coating compositions, one or more cationic compounds and a dispersion of a polymeric carboxylic compounds soluble in an alkaline medium. The use of the special compositions ensures, with a relatively thin film having low applied weight per unit area, excellent coverage of the fibers which is observed as an improvement in the appearance of the surface, the brightness and smoothness thereof, and improved printability and opacity.

According to the invention, the cationic compounds are selected from the group of the following classes:

(a) polyalkylene-polyamines of high molecular weight;

(b) polyalkylene-imines such as especially poly ethylene-imine;

(c) cationic polyamides such as those obtained by the reaction of polyalkylene-polyamine with a saturated or unsaturated dibasic acid followed by condensation of the reaction product with epichlorohydrin;

(d) cationic polyamide-polyester copolymers such as those obtained by the process described in the commonly owned French Pat. No. 74 40699 (see especially U.S. Pat. No. 4,075,177 issued to Jacques Claude BONNET and Gerard TESSON and also commonly assigned with the present application);

(e) polyurethane-oxyalkylene copolymers which, in aqueous medium, have a cationic character and of the type obtained by the process described in French Pat. No. 74 27 562 (corresponding to U.S. Pat. No. 4,053,441 issued to Jacques C. BONNET and Alain RIBBA and commonly assigned with the present application);

(f) cationic acrylic copolymer derived by the copolymerization of acrylamide with acrylic polymers containing amine groups or quaternary ammonium groups, the product of this type can be and preferably is a copolymer of acrylamide and methacryloxy-trimethylammoniumchloride;

(g) polymeric amylaceous materials of a cationic character such as and preferably that which is formed by the reaction of starch with an equimolar quantity of glycidaltrimethylammoniumchloride; and (h) cationic polymeric aminoplasts such as those obtained by the process described in French Pat. No. 74 27 207 (corresponding to the commonly assigned copending application Ser. No. 600,906 of Gerard Tesson now abandoned); alternatively the materials of this class can be the products obtained by the reaction of urea with formaldehyde in the presence of polyfunctional amine soluble in water such monoethylene amine, diethylene amine, triethylene amine or ethylene diamine.

The polymeric carboxyl compounds which are soluble in aqueous alkali, according to the present invention are preferably alkali metal salts or alkaline earth metal salts of unsaturated carboxylic acids (such as acrylic acid, methacrylic acid, itaconic acid) or with copolymers obtained by the polymerization of unsaturated carboxylic acid esters with the above-mentioned carboxylic acids, these copolymers being rendered soluble by neutralization with alkaline-metal hydroxide or alkaline earth metal hydroxide or some other base having an alkali metal or alkaline earth metal cation.

The preferred esters are the methylacrylates, the ethylacrylates, the propylacrylates, butylacrylates, and the 2-ethylhexylacrylates. The esters may also be methacrylates such as methylmethacrylate, ethyl methacrylate, propyl methacrylate, butyl methacrylate and 2-ethylhexyl methacrylate.

The coating and sizing compositions which may be used in accordance with the present invention may be any of those described, for example, on pages 810ff of *Chemical and Process Technology Encyclopedia*, McGraw-Hill Book Co., New York, 1974. These include those compositions which improve the printing quality of paper and consist predominantly of aqueous suspensions of pigments, such as clay, in adhesives such as starch to provide a smoother surface, control the penetration of inks, improve the pick resistance, appearance, brightness and increase the opacity. The apparatus described in this publication may also be used for the coating process according to the invention.

The addition to classical sizing compositions of the compounds according to the present invention increases substantially the resistance of the sizing layer to solubilization. As a consequence, there is a significant improvement in the tear resistance of the coated paper stock during printing in a humid environment. This also can be understood as an increase in the resistance to friction in a moist state of the paper.

The compositions according to the invention have been found to be particularly effective in the production of lightweight sized paper for printing purposes.

For example, I prefer to make use of paper stock with a basis weight of 36 to 40 g/m$^2$ sized with 12 to 14 g/m$^2$ (6 to 7 g/m$^2$on each ace) of the coating composition, thereby obtaining a paper with a final basis weight of 48 to 52 g/m$^2$ with excellent printability. In fact, it has been found that such papers have as good printability and appearance qualities as papers having a basis weight of 60 g/m$^2$ and sized with a coating of 20 g/m$^2$.

The concentrations in which the additives of the present invention are employed, expressed in terms of dry material with respect to the weight of the pigment of the sizing composition, can be 0.1 to 2% by weight of the polymeric carboxyl compound soluble in the aqueous medium and preferably between 0.25 and 1% by weight. The concentration of the cationic compound, expressed in terms of dry material with reference to the weight of pigment, varies between 0.03 and 1% by weight and is preferably between 0.05 and 0.2%.

The use of these additives in the prescribed proportions gives compositions which are highly thixotropic and which have been found to be particularly effective for coating at high speeds.

SPECIFIC EXAMPLES

The Examples given below are illustrative of the present invention.

EXAMPLE I

The bath was coated onto the paper in a pilot coating machine rotating at 50 m/minute and of the double-roller type described in the aforementioned publication.

Basis weight of the paper: 40 g/m$^2$

Weight of the layer deposited: 6 g/m$^2$

| | I | II |
|---|---|---|
| pigment: Kaolin | 70 | 70 |
| calcium carbonate | 30 | 30 |
| starch binder | 6 | 6 |
| styrene binder | 7 | 7 |
| butylacrylate dispersant (sodium polyacrylate) | 7 | 7 |
| polymeric carboxyl compound (copolymer of ethylacrylate, methacrylic acid, vinyl triethoxy silane and triallyl phosphate described in French patent 2,218,351) | | 0.8 |
| urethane oxyalkylene polymer | | 1.25 |
| concentration of dry material | 65% | 65% |
| pH | 8 | 8 |
| Brookfield viscosity 50 t/mn | 720 cps | 870 cps |
| 100 t/mn | 480 cps | 570 cps |

The following results were obtained with the two sized papers:

| | | |
|---|---|---|
| micro contour test (porometric ink) | average | good |
| opacity (Elrepho) | 64 | 66.5 |
| whiteness (Elrepho) | 88 | 89 |
| wet test on IGT apparatus | average | good |
| resistance to moist friction | average | good |

EXAMPLE II

On a pilot sizing machine rotating at 900 m/minute, a paper was processed which had a basis weight of 36 g/m$^2$. The composition deposited on both surfaces was 12 g/m$^2$ corresponds to 6 g/m$^2$ on each face.

| | I | II |
|---|---|---|
| Kaolin pigment | 100 | 100 |
| starch thickener | | 0.8 |
| polymeric carboxyl compound described in Example I | 0.8 | |
| polyethylene imine (m.w. 4000–6000) | 0.075 | |
| styrene-butadiene binder | 4.45 | 4.45 |
| aluminum stearate | 0.73 | 0.73 |
| content of dry material | 47% | 47% |
| pH | 8.67 | 8.63 |
| Brookfield viscosity 50 t/mn | 3880.cps | 940 cps |
| 100 t/mn | 2240 cps | 570 cps |
| High Shear viscosity (mn) | 32/34.5 | 12.5/13 |
| moisture retention (Warren method in seconds) | 28.5 | 32 |

The following results were found with the sized papers:

| | | |
|---|---|---|
| smoothness (Bekk method in seconds) | 1510 | 1270 |
| brilliancy angle 45° | 4.0 | 3.7 |
| whiteness (Elrepho) | 71.6 | 70.4 |
| opacity (Elrepho) | 93.1 | 91.4 |
| "micro contour test" with porometric ink | very good | bad |

-continued

| | | |
|---|---|---|
| printability with engraved cylinder | good | average |

The foregoing shows a clear superiority with the improved sizing bath over the standard baths. Furthermore, the pressure of the blade, controlled at 1.6 to 1.8 kg/cm$^3$ for bath I of test II does not require modification during the test while the blade for bath II must have its pressure modified between 2 and 2.7 kg/cm$^3$ in order to maintain the coating level at 6 g/m$^2$.

EXAMPLE III

The following baths are coated on a pilot coating machine rotating at 900 m/minute onto paper with a basis weight of 70 g/m$^2$. The weight of the deposited coating was 10 g/m$^2$.

| | A | B |
|---|---|---|
| pigments: Kaolin | 70 | 70 |
| calcium carbonate | 30 | 30 |
| starch binder | 7.5 | 7.5 |
| styrene-butadiene binder | 6.5 | 6.5 |
| thermosetting resin | 0.45 | 0.45 |
| polymeric carboxyl compound described in Example I | 0.8 | |
| polyethylene imine | 0.12 | |
| content of dry material | 50% | 50% |
| pH | 8.9 | 8.9 |
| Brookfield viscosity 50 t/mn | 3200 cps | 860 cps |
| 100 t/mn | 1700 cps | 520 cps |

The results below were found for the coated papers:

| | A | B |
|---|---|---|
| smoothness (Bekk method in seconds) | 1960 | 1560 |
| brilliancy angle 45° | 7.0 | 5.4 |
| whiteness (Elrepho) | 74.5 | 73.9 |
| opacity (Elrepho) | 91.5 | 90.5 |
| wet test on IGT apparatus | good | average |
| "micro contour test" with porometric ink | very good | bad |
| Offset printability | very good | average |

The above results also show a clear superiority for the improved composition according to the present invention.

I claim:

1. A composition for coating paper consisting essentially of about 100 parts of Kaolin pigment, about 0.8 parts of a copolymer of ethylacrylate, methacrylic acid, vinyl trimethoxy silane and triallyl phosphate; about 0.75 parts of a polyethyleneimine of molecular weight of 4000 to 6000; about 4.45 parts of a styrene-butadiene binder; about 0.73 parts of aluminum stearate; and an effective amount of a sizing compound.

2. A composition for coating paper consisting essentially of a pigment containing about 70 part Kaolin and about 30 parts calcium carbonate; about 7.5 parts of a starch binder; about 6.5 parts of a styrene-butadiene binder; about 0.45 parts of a thermosetting resin; about 0.8 parts of a copolymer of ethylacrylate, methacrylic acid, vinyl trimethoxy silane and trialkyl phosphate; about 0.12 parts of polyethyleneimine of molecular weight of 4000 to 6000 and an effective amount of a sizing component.

* * * * *